US008654996B2

(12) United States Patent
Yao

(10) Patent No.: US 8,654,996 B2
(45) Date of Patent: Feb. 18, 2014

(54) SPACER FOR A CAPACITIVE MICROPHONE AND CAPACITIVE MICROPHONE WITH THE SAME

(75) Inventor: Rongguo Yao, Weifang (CN)

(73) Assignee: Goertek Inc., Weifang (CN)

( * ) Notice: Subject to any disclaimer, the term of this patent is extended or adjusted under 35 U.S.C. 154(b) by 101 days.

(21) Appl. No.: 13/145,019

(22) PCT Filed: Nov. 16, 2009

(86) PCT No.: PCT/CN2009/074952
§ 371 (c)(1),
(2), (4) Date: Jul. 18, 2011

(87) PCT Pub. No.: WO2010/081347
PCT Pub. Date: Jul. 22, 2010

(65) Prior Publication Data

US 2011/0274300 A1 Nov. 10, 2011

(30) Foreign Application Priority Data

Jan. 19, 2009 (CN) ..... 2009 2 0018530 U

(51) Int. Cl.
*H04R 25/00* (2006.01)

(52) U.S. Cl.
USPC ..... 381/174; 381/369

(58) Field of Classification Search
USPC ..... 381/191, 190, 369, 173–176
See application file for complete search history.

(56) References Cited

U.S. PATENT DOCUMENTS

| | | | | |
|---|---|---|---|---|
| 4,876,211 | A * | 10/1989 | Kanber et al. | 438/379 |
| 5,764,595 | A * | 6/1998 | Power | 367/103 |
| 2002/0076076 | A1 * | 6/2002 | Kay et al. | 381/355 |
| 2003/0021432 | A1 * | 1/2003 | Scheeper et al. | 381/174 |
| 2004/0056246 | A1 * | 3/2004 | Yan et al. | 257/40 |
| 2004/0157426 | A1 * | 8/2004 | Ouellet et al. | 438/618 |
| 2005/0281419 | A1 * | 12/2005 | Miyazaki et al. | 381/191 |
| 2006/0002575 | A1 * | 1/2006 | Akino | 381/361 |
| 2006/0086281 | A1 * | 4/2006 | Poulet et al. | 106/14.5 |
| 2007/0272992 | A1 * | 11/2007 | Mori et al. | 257/416 |
| 2007/0286438 | A1 * | 12/2007 | Hirade et al. | 381/175 |

FOREIGN PATENT DOCUMENTS

| | | | | |
|---|---|---|---|---|
| CN | 1784084 A * | 6/2006 | | H04R 19/04 |
| RU | 2193255 C1 * | 11/2002 | | H01L 21/18 |

* cited by examiner

*Primary Examiner* — Suhan Ni
(74) *Attorney, Agent, or Firm* — Troutman Sanders LLP

(57) ABSTRACT

The present invention relates to a spacer for a capacitive microphone and a capacitive microphone with such spacer, in which the spacer is mounted between polar plates and vibrating diaphragm of the microphone and the spacer comprises at least one insulating layer and at least one conductive layer bonded with the insulating layer. With the above-mentioned structure, static electricity is effectively prevented from occurring or storing during manufacturing process of the spacer and meanwhile, disadvantages such as difficult processing, high cost and tendency to increase parasitic capacitance while making spacer with metal sheet are overcome.

9 Claims, 4 Drawing Sheets

Legend: 1 - Circuit board substrate
2 - Circuit board frame
3 - Circuit board base plate
4 - Elastic metal connection device
5 - Polar plates
6 - Spacer
7 - Vibrating Diaphragm
11 - Surface mountable electrode
12 - Signal amplification device
31 – Sound hole
71 - Vibrating ring Legend: 1 - Circuit board substrate
2 - Circuit board frame
3 - Circuit board base plate
4 - Elastic metal connection device
5 - Polar plates
6 - Spacer
7 - Vibrating Diaphragm
11 - Surface mountable electrode
12 - Signal amplification device
31 – Sound hole
71 - Vibrating ring Legend: 5 - Polar plates
6 - Spacer
61- Organic material layer
62 - Metal layer
7 - Vibrating Diaphragm
71 - Vibrating ring Legend: 6 - Spacer
63- Connecting ribs Legend: 6 - Spacer
63- Connecting ribs
64- Connecting section Legend: 6 - Spacer Legend: 6 - Spacer
64- Connecting section

SPACER FOR A CAPACITIVE MICROPHONE AND CAPACITIVE MICROPHONE WITH THE SAME

FIELD OF THE INVENTION

The present invention relates to a capacitive microphone, and more particularly, to a spacer for the capacitive microphone.

BACKGROUND OF THE INVENTION

In recent years, capacitive microphones, due to their low price and excellent performance, have been widely applied in electronic products such as cell phones and earphones. The critical element for a capacitive microphone is a capacitor component comprised of polar plates, a vibrating diaphragm and a spacer provided therebetween.

The spacer in a capacitive microphone mainly functions to isolate polar plates and the vibrating diaphragm to form a parallel plate capacitor. Generally, the spacer may be fabricated in advance, that is, the spacer is formed as a single separate ring sheet by punching and cutting and then mounted into the capacitive microphone. In some product structures, it is also possible to mount spacers that are not separated into a plurality of capacitive microphones arranged in an array and then separate them by punching and cutting. For example, the patent application No. CN200610099179.6 discloses a structure in which parts of multiple capacitive microphones are arranged in array and then cut separate after being assembled together, which teaches that the spacer is made from resin film or metal sheet.

However, if the spacer is made from resin film, the low cost and easy fabrication can be obtained, but static electricity may be easily produced during separation process, which causes impact on product performance. Furthermore, if the spacer is made from a metal sheet, the above electro-static problem may be solved, however, both the fabrication difficulty and costs are increased. Further, parasitic capacitance between polar plates and vibrating diaphragm is increased, and the sensibility limit of products is deteriorated. Therefore, it is needed for a capacitive microphone that is of low cost, simple structure and able to mitigate electrostatic influence.

SUMMARY OF THE INVENTION

The technical problem to be solved by the present invention is to provide a spacer for a capacitive microphone that has low cost and is not likely to induce electrostatic influence.

To solve the above technical problem, the technical solution of the present invention is a spacer for a capacitive microphone mounted between polar plates and vibrating diaphragm, the spacer comprises at least one insulating layer and at least one conductive layer bonded with the insulating layer.

The improvement of the present solution lies in that the insulating layer is an organic material layer, and the conductive layer is a quasi-metallization layer or a metal layer.

The improvement of the present solution lies in that the spacer comprises an organic material layer and a metal layer.

The improvement of the present solution lies in that the spacer comprises an organic material layer, on both sides of which is provided with a metal layer respectively.

The improvement of the present solution lies in that the metal layer has a thickness of 0.001 mm~0.01 mm.

The improvement of the present solution lies in that the organic material layer has a thickness of 0.01 mm~0.1 mm.

The improvement of the present solution lies in that the spacer has a ring-shaped structure and a plurality of connecting ribs are provided on the periphery of the spacer.

The improvement of the present solution lies in that the spacer has a ring-shaped structure and a periphery of the spacer is of square-shape.

The improvement of the present solution lies in that the insulating layer is an organic high molecular material layer, and the conductive layer is a conductive layer formed by conducting antistatic treatment on a surface of the organic high molecular material with proton bombardment technology in plasma environment.

The improvement of the present solution lies in that the organic material layer is an organic high molecular material layer, and the quasi-metallization layer or the metal layer is implemented by bombing the organic high molecular material layer with metal ions so as to metallize or quasi-metallize a surface of the organic high molecular material layer.

The improvement of the present solution lies in that the organic material layer is an organic high molecular material layer, and the metal layer is implemented by depositing a metal on the organic high molecular material layer with a wet chemical method such as electroplating or hot dipping.

The present invention further provides a capacitive microphone that uses the above various spacers, which can reduce product manufacturing costs and improve the quality of products effectively.

With the above solution, a spacer for a capacitive microphone is mounted between polar plates and vibrating diaphragm, and the spacer comprises at least one insulating layer and at least one conductive layer bonded with the insulating layer. The beneficial effects of the present invention is as follow: static electricity may be effectively prevented from occurring or being stored during manufacturing process of the spacer, and meanwhile, disadvantages such as difficult processing, high cost and tendency to increase parasitic capacitance while making spacer with metal sheet are overcome.

DETAILED DESCRIPTION OF THE INVENTION

First Embodiment

The spacer for a capacitive microphone according to the present invention will be described in detail with reference to drawings in below.

Figure 1:
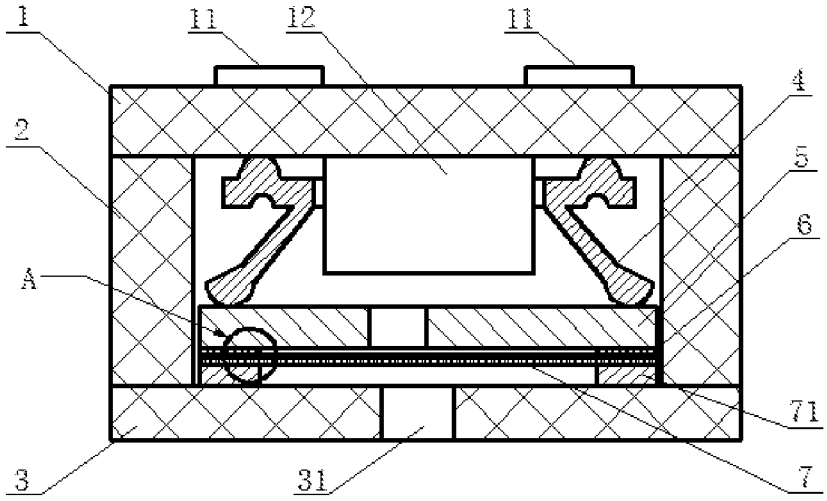
FIG. 1 is a cross-sectional view showing a specific structure of a capacitive microphone provided with a spacer according to the present invention.

FIG. 1 is a cross-sectional view showing a specific structure of a capacitive microphone provided with the spacer according to the present invention. As shown in FIG. 1, the capacitive microphone with the spacer according to the present invention comprises a circuit board substrate 1 on the top, a circuit board base plate 3 on the bottom and a circuit board frame 2 between the circuit board substrate and the circuit board base plate, all or part of which may be fabricated from a circuit board and constitute a protection structure for the capacitive microphone. Here, a plurality of surface mountable electrodes 11 are provided on the top surface of the circuit board substrate 1 that faces outside of the microphone, and a signal amplification device 12 is provided on the bottom surface that faces inside of the microphone. In addition, a sound hole 31 for receiving outside sound signals is provided on the circuit board base plate 3. Furthermore, inside the microphone, there are mounted a elastic metal connection device 4, polar plates 5, a spacer 6, a vibrating diaphragm 7 and a vibrating ring 71 for securing the vibrating diaphragm 7, in which the polar plates 5, the vibrating diaphragm 7 and the spacer 6 provided therebetween constitute a capacitor component for a capacitive microphone.

The elastic metal connection device 4 has one end connected to the polar plates 5 and another end connected to the circuit board substrate 1, thereby electrically connecting the polar plates 5 and the circuit board substrate 1. The vibrating diaphragm 7 is connected to the circuit board substrate 1 via the vibrating ring 71 and a circuit (not shown) between the circuit board base plate 3 and the circuit board frame 2, and necessary circuits are provided on both sides of and inside of the circuit board substrate 1. Further, the signal amplification device 12 may function to amplify electrical signals. Normally, these are well known technology and will not be described in detail herein.

Figure 2:
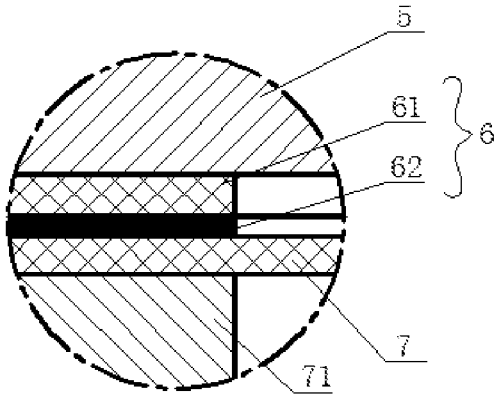
FIG. 2 is an enlarged schematic diagram of part A of the above mentioned capacitive microphone.

FIG. 2 is an enlarged schematic diagram of part A of the above mentioned capacitive microphone. As shown in FIG. 2, the spacer 6 comprises an organic material layer 61 and a metal layer 62 provided over or under the organic material layer 61. With this dual-layer spacer structure, during manufacturing process of the spacer, merits of both the metal sheet and the organic material themselves may be utilized at the same time, and the fabrication process might be rather simple, which only needs to coat a metal layer on an organic material layer. In addition, the metal layer 62 preferably has a thickness of 0.001~0.01 mm, and the organic material layer 61 preferably has a thickness of 0.01~0.1 mm. Materials such as copper foil, aluminum foil may be used for the metal layer, and materials such as PI may be used for the organic material layer.

Figure 3:
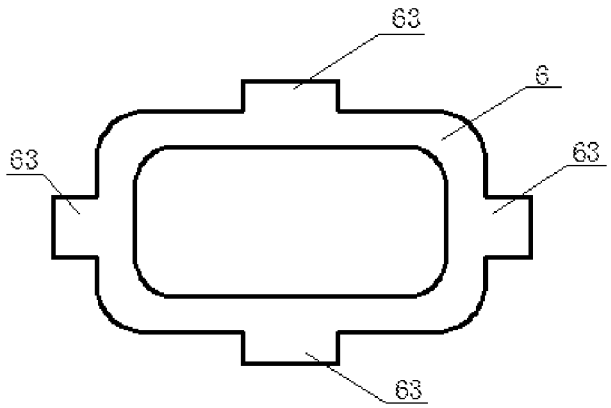
FIG. 3 is a planar view showing a specific structure of an individual spacer according to a first embodiment of the present invention.
Figure 4:
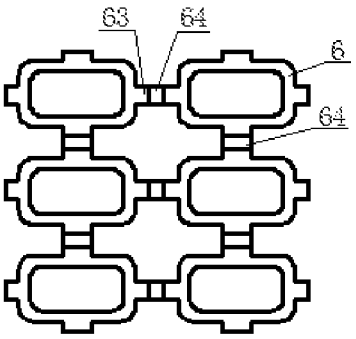
FIG. 4 is a planar view showing a spacer array according to the first embodiment of the present invention.

FIG. 3 is a planar view showing a specific structure of an individual spacer according to the first embodiment of the present invention. As shown in FIG. 3, the spacer 6 has a general ring-shaped structure with an opening section at the center and four equally spaced connecting ribs 63 which are integrally formed and extending outward. Here, four connecting ribs 63 are described as an example, however, the number of ribs 63 on a spacer is not limited to 4, but may be any number above 2. Generally, while manufacturing an individual capacitive microphone, the ringshaped spacer may be fabricated by punching and cutting, and then mounted into the capacitive microphone individually. However, while manufacturing array microphones suitable for mass automatic production, it is also possible to manufacture a spacer array with multiple spacers integrated in one piece by punching and then mount the spacer array into multiple capacitive microphones at the same time, after which individual spacers left in respective microphones are separated by cutting. FIG. 4 is a planar view showing the spacer array according to the first embodiment of the present invention, wherein 6 spacers form a 2×3 array and connecting ribs 63 of adjacent individual spacers are connected with each other via a connecting section 64. The spacer array thus formed is mounted into multiple capacitive microphones at the same time, and individual spacers are made in separate status by cutting connecting sections 64 between adjacent spacers to thereby allowing them remain in individual capacitive microphones.

Second Embodiment

The specific structure of the spacer according to the second embodiment of the present invention will be explained below. Compared with the structure of the first embodiment in which the spacer is comprised of a metal layer 62 and an organic material layer 61, the spacer of the second embodiment comprises two metal layers 62 located at outer levels and an organic material layer 61 sandwiched between these two metal layers. This structure may also realize effect similar to the first embodiment.

Figure 5:
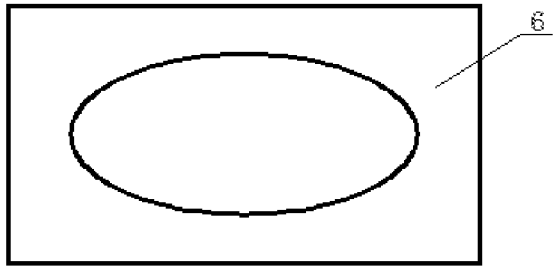
FIG. 5 is a planar view showing a specific structure of an individual spacer according to a second embodiment of the present invention.
Figure 6:
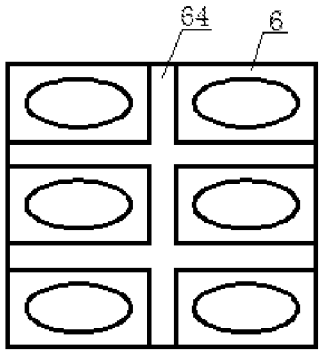
FIG. 6 is a planar view showing a spacer array according to the second embodiment of the present invention.

In addition, FIG. 5 shows another shape of the spacer 6 after modification, i.e. the spacer 6 is shaped as a square-shaped structure with an elliptic opening provided in the center. FIG. 6 shows the structure of a spacer array formed by connecting multiple spacers 6 shown in FIG. 5 together, wherein adjacent spacers 6 are connected via connecting sections 64 therebetween. Here, the connecting section 64 has an elongated strip shape extending along an edge of the spacer 6, and this structure is also applicable to requirements of microphones by mass automatic production and may further enhance connections between individual spacers. It is understood that the structure of connecting rib 64 of the first embodiment may also be applied here.

In order to further reduce manufacturing cost, in a preferred implementation of the present invention, the organic material layer 61 is a high molecular organic material layer, and the metal layer 62 is implemented by depositing a metal on the organic material layer 61 with a wet chemical method such as electroplating or hot dipping.

In a preferred implementation of the present invention, it is also possible to use a quasi-metallization layer that equally has electrical conductivity instead of the metal layer, which may also effectively avoid static electricity production or storage during manufacturing process of the spacer.

Meanwhile, with respect to the quasi-metallization layer and metal layer of the present invention, it is also possible to bombard the high molecular organic material layer with metal ions so as to make the surface thereof metallized or quasi-metallized, thereby imparting it with electrical conductivity and electrostatic prevention function. With this process, the resulting quasi-metallization layer and the metal layer are securely bonded on the high molecular organic material layer and are not likely to suffer from wearing and peeling, which might realize better product reliability and product performance after being applied to the capacitive microphone product.

In the present invention, other forms of conductive layers may also be used for the conductive layers of the spacer. For instance, a high molecular organic material layer is used as an insulating layer, and the high molecular organic material layer is placed in plasma environment to be surface processed by proton bombardment technology so as to form a conductive layer on the originally insulating organic material layer, thereby imparting the spacer with antistatic function. Also, this process will not change other characteristics of the organic material layer and has the feature of being environmentally friendly.

As provided in the specification, the method of providing metallic conductive layer (quasi-metallic conductive layer) or other conductive layer on organic material layer is a preferred method of the present invention. Other similar methods in which an organic material layer is used as base material and a metal layer or quasi-metal layer or other conductive layer is provided on the organic material layer to impart the entire spacer with conductivity and antistatic function should be interpreted as equivalent method of the present invention.

The present invention further provides a capacitive microphone that uses the above mentioned various spacers, which can reduce product manufacturing costs and improve the quality of products effectively.

The above detail description of the spacer for a capacitive microphone and the capacitive microphone with such spacer claimed by the present invention is merely explanation of the principle and implementations of the present invention with reference to specific embodiments, and the explanation of the above embodiments is only to help understanding the gist of the present invention. Meanwhile, modifications to specific implementations and fields of application may occur to those skilled in the art according to the teaching of the present invention. In summary, the description should not be interpreted as limiting the present invention.

What is claimed is:

1. A spacer for a capacitive microphone, said capacitive microphone comprising one or more polar plates and a vibrating diaphragm, said spacer is mounted between the polar plates and the vibrating diaphragm, the spacer comprises at least one insulating layer and at least one conductive layer bonded with the insulating layer, wherein the insulating layer is an organic material layer, the conductive layer is a quasi-metallization layer or a metal layer; and the spacer has a ring-shaped structure and a plurality of connecting ribs are provided on periphery of the spacer.

2. The spacer for a capacitive microphone of claim 1, wherein the spacer comprises a first organic material layer, a first metal layer is provided on one side of the first organic material layer.

3. The spacer for a capacitive microphone of claim 2, wherein the first metal layer has a thickness of 0.001 mm~0.01 mm.

4. The spacer for a capacitive microphone of claim 2, wherein the first organic material layer has a thickness of 0.01 mm~0.1 mm.

5. The spacer for a capacitive microphone of claim 1, wherein the spacer has a ring-shaped structure and a periphery of the spacer is of square shape.

6. The spacer for a capacitive microphone of claim 1, wherein the insulating layer is an organic high molecular material layer, and the conductive layer is a conductive layer formed by conducting antistatic treatment on a surface of the organic high molecular material with proton bombardment technology in plasma environment.

7. The spacer for a capacitive microphone of claim 1, wherein the organic material layer is an organic high molecular material layer, and the quasi-metallization layer or the metal layer is implemented by bombarding the organic high molecular material layer with metal ions so as to metallize or quasi-metallize a surface of the organic high molecular material layer.

8. The spacer for a capacitive microphone of claim 1, wherein the organic material layer is an organic high molecular material layer, and the metal layer is implemented by depositing a metal on the organic high molecular material layer with a wet chemical method.

9. A capacitive microphone, wherein the capacitive microphone comprises the spacer of any one of claims 1-4 and 5-8.

* * * * *